US010698360B1

(12) United States Patent
Ishikura et al.

(10) Patent No.: US 10,698,360 B1
(45) Date of Patent: Jun. 30, 2020

(54) IMAGE FORMING APPARATUS

(71) Applicant: FUJI XEROX CO., LTD., Tokyo (JP)

(72) Inventors: Kenichi Ishikura, Kanagawa (JP); Kazuhiro Tobita, Kanagawa (JP); Takeshi Nagano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/519,310

(22) Filed: Jul. 23, 2019

(30) Foreign Application Priority Data

Mar. 14, 2019 (JP) ..... 2019-047324

(51) Int. Cl.
*G03G 21/16* (2006.01)

(52) U.S. Cl.
CPC ... *G03G 21/1633* (2013.01); *G03G 2221/169* (2013.01); *G03G 2221/1687* (2013.01)

(58) Field of Classification Search
CPC ..... G03G 21/1633; G03G 2221/1687; G03G 2221/169
See application file for complete search history.

(56) References Cited

U.S. PATENT DOCUMENTS 7,386,255 B2 * 6/2008 Ochi ..... G03G 21/1633 399/121
7,460,814 B2 * 12/2008 Ito ..... B41J 11/006 347/104
7,917,057 B2 * 3/2011 Koyanagi ..... G03G 15/16 399/110
8,712,312 B2 * 4/2014 Lee ..... G03G 21/1633 399/392
8,737,868 B2 * 5/2014 Tanabe ..... G03G 21/1633 399/107
9,709,948 B2 7/2017 Wakimoto
9,864,323 B2 * 1/2018 Uohashi ..... G03G 21/1633
10,025,259 B2 7/2018 Doi et al.
10,386,781 B2 * 8/2019 Shima ..... G03G 15/165
2005/0036804 A1 * 2/2005 Yokoi ..... G03G 21/1638 399/124
2006/0018672 A1 * 1/2006 Asaba ..... G03G 15/70 399/21
2006/0104665 A1 * 5/2006 Koshida ..... G03G 21/1638 399/124

(Continued)

FOREIGN PATENT DOCUMENTS

JP 2017-003892 A 1/2017

*Primary Examiner* — Ryan D Walsh
(74) *Attorney, Agent, or Firm* — Sughrue Mion, PLLC

(57) ABSTRACT

An image forming apparatus includes a covering provided along a side surface of a body of the image forming apparatus, provided with a rotation shaft on a lower side of the covering, and provided to be openable and closable with respect to the body; an interior section provided on a side of the covering near the body, releasably coupled to the covering by a coupling portion, and provided to be openable and closable with respect to the body; a first limit portion that is attached to the interior section and the body, and that limits a maximum opening angle between the interior section and the body; and a second limit portion that is attached to the covering and the body, and that limits a maximum opening angle between the covering and the body to an angle larger than the maximum opening angle between the interior section and the body.

6 Claims, 8 Drawing Sheets

(56) References Cited

U.S. PATENT DOCUMENTS

| | | | | |
|---|---|---|---|---|
| 2007/0215594 | A1* | 9/2007 | Hashimoto | B41J 29/13 219/400 |
| 2008/0080893 | A1* | 4/2008 | Asahina | G03G 21/1633 399/114 |
| 2008/0138111 | A1* | 6/2008 | Ju | G03G 21/1628 399/121 |
| 2008/0240780 | A1* | 10/2008 | Yamauchi | G03G 21/1633 399/121 |
| 2011/0188885 | A1* | 8/2011 | Fukunaga | G03G 15/00 399/110 |
| 2014/0212195 | A1* | 7/2014 | Aoyama | G03G 15/6529 399/405 |
| 2015/0084277 | A1* | 3/2015 | Maruyama | B65H 1/04 271/272 |
| 2016/0102488 | A1* | 4/2016 | Doi | E05F 5/06 49/350 |
| 2016/0161908 | A1* | 6/2016 | Wada | G03G 21/1633 399/110 |
| 2017/0060068 | A1* | 3/2017 | Hori | G03G 15/234 |
| 2017/0248898 | A1* | 8/2017 | Sato | G03G 21/1623 |
| 2017/0293253 | A1* | 10/2017 | Iwase | G03G 21/1633 |
| 2018/0004151 | A1* | 1/2018 | Tsuda | G03G 21/1633 |
| 2018/0088521 | A1* | 3/2018 | Naganuma | G03G 21/1638 |
| 2019/0137912 | A1* | 5/2019 | Kasama | G03G 15/2028 |

* cited by examiner

IMAGE FORMING APPARATUS

CROSS-REFERENCE TO RELATED APPLICATIONS

This application is based on and claims priority under 35 USC 119 from Japanese Patent Application No. 2019-047324 filed Mar. 14, 2019.

BACKGROUND

(i) Technical Field

The present disclosure relates to an image forming apparatus.

(ii) Related Art

Japanese Unexamined Patent Application Publication No. 2017-3892 discloses a covering opening/closing mechanism including a top covering member rotatable around a rotation shaft, a moving member that reciprocates in a first positive direction and a first negative direction in a contact state with the top covering member along with an opening/closing operation of the top covering member, a first urging member that urges the moving member, which is moving in the first negative direction, in the first positive direction, when the top covering member rotates in a closing direction, a gear coupled to the top covering member, and a damper that generates a load corresponding to the rotation speed of the gear.

SUMMARY

Aspects of non-limiting embodiments of the present disclosure relate to obtaining an image forming apparatus having a structure in which a covering and an interior section provided on the inner side of the covering are provided to be openable and closable with respect to a body of an image forming apparatus around a rotation shaft provided on the lower side of the covering, the image forming apparatus being capable of suppressing deformation of the covering as compared with a structure in which a limit portion that limits the angle of the opening is attached to only a position between the covering and the body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a covering provided along a side surface of a body of the image forming apparatus, provided with a rotation shaft on a lower side of the covering, and provided to be openable and closable with respect to the body; an interior section provided on a side of the covering near the body, releasably coupled to the covering by a coupling portion, and provided to be openable and closable with respect to the body; a first limit portion that is attached to the interior section and the body, and that limits a maximum opening angle between the interior section and the body; and a second limit portion that is attached to the covering and the body, and that limits a maximum opening angle between the covering and the body to an angle larger than the maximum opening angle between the interior section and the body.

BRIEF DESCRIPTION OF THE DRAWINGS

An exemplary embodiment of the present disclosure will be described in detail based on the following figures, wherein.

DETAILED DESCRIPTION

First Exemplary Embodiment

Figure 1:
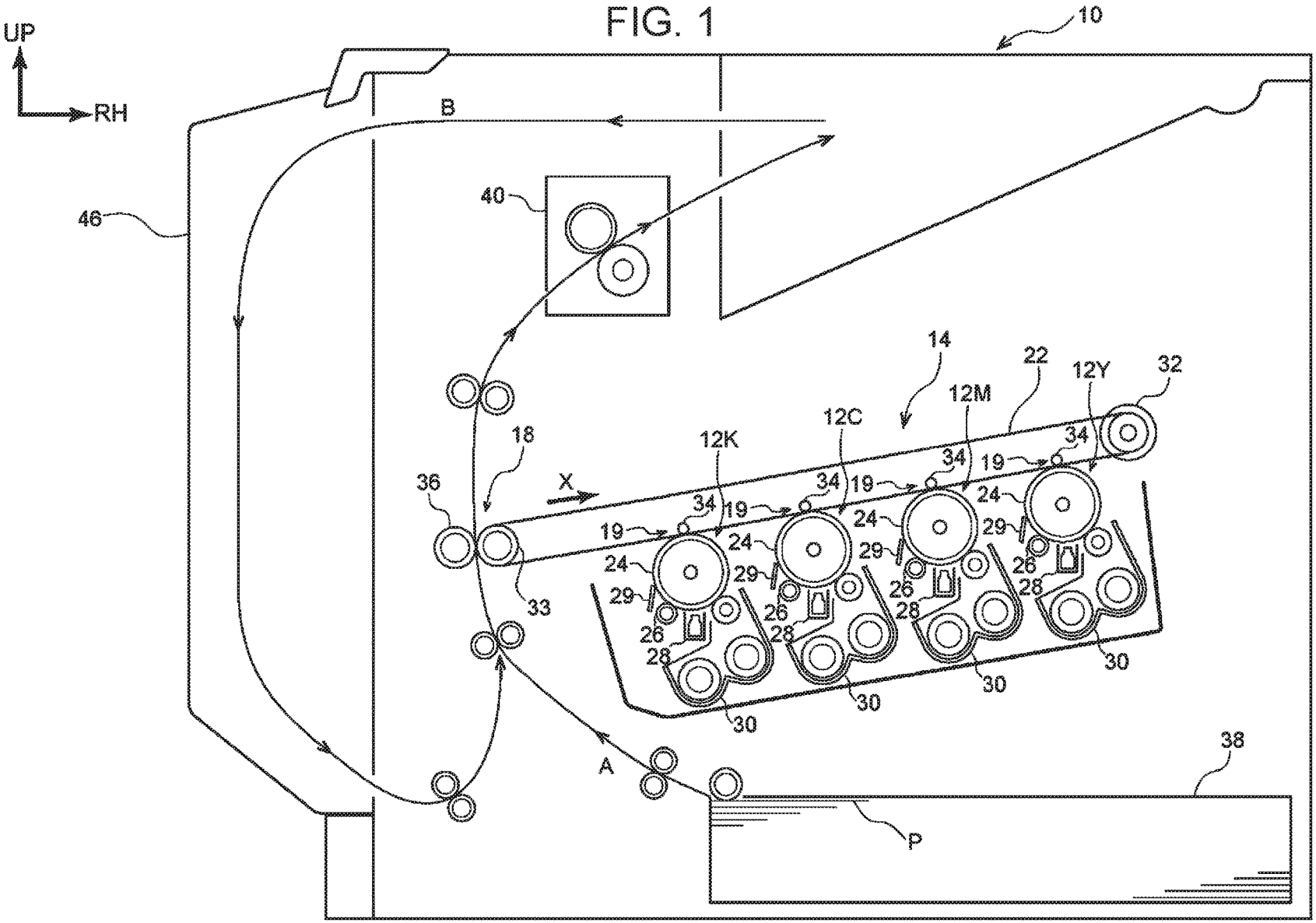
FIG. 1 is a front view schematically illustrating the inner structure of an image forming apparatus according to the exemplary embodiment.
Figure 2:
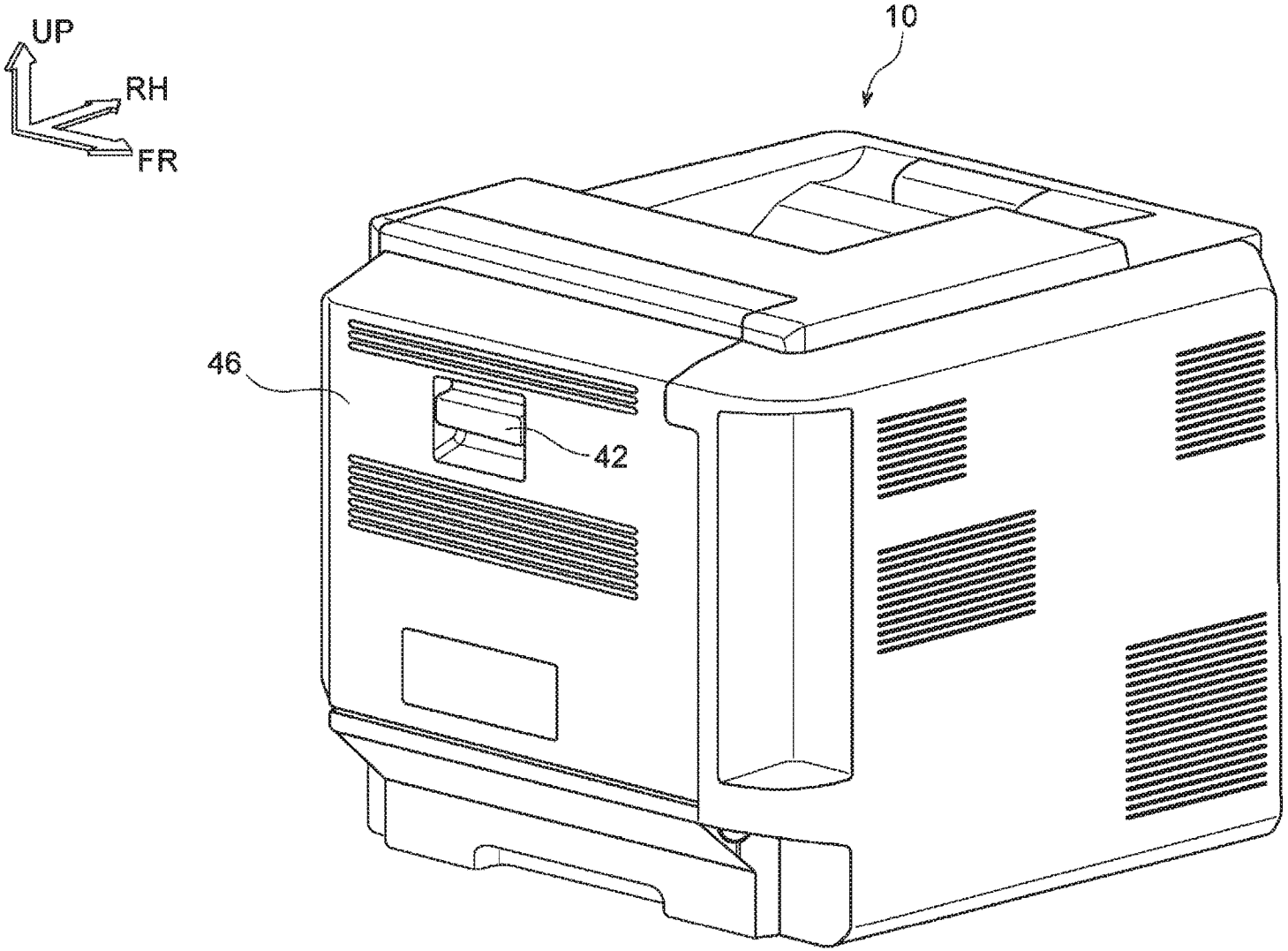
FIG. 2 is a perspective view illustrating the appearance of the image forming apparatus according to the exemplary embodiment.

An example of an image forming apparatus (occasionally merely referred to as "apparatus") according to a first exemplary embodiment of the disclosure is described with reference to FIGS. 1 to 8. Arrow UP in each figure indicates the vertical direction and the apparatus up direction. As illustrated in FIG. 1, arrow RH is the horizontal direction and the right side when a viewer faces the apparatus. As illustrated in FIG. 2, arrow FR is the horizontal direction and the near side when the viewer faces the apparatus. Moreover, when the up-down direction is designated in the description given below without noted, the up-down direction represents the up or down direction of the apparatus illustrated in FIG. 1. When the left-right direction is designated in the description given below without noted, the left-right direction represents the left or right (=RH) direction when the viewer faces the apparatus illustrated in FIG. 1. When the depth direction is designated in the description given below without noted, the depth direction represents the near side (=FR) or far side in the depth direction when the viewer faces the apparatus illustrated in FIG. 1.

General Configuration of Image Forming Apparatus 10

A configuration of an image forming apparatus 10 is now described. FIG. 1 is a front view schematically illustrating the image forming apparatus 10 according to this exemplary embodiment.

As illustrated in FIG. 1, the image forming apparatus 10 includes an image forming unit 12 that forms an image by electrophotographic system, an intermediate transfer belt 22 that holds the formed image, and an intermediate transfer unit 14 that holds the intermediate transfer belt 22. In addition, in the image forming apparatus 10, a second transfer roller 36 that transfers the image from the intermediate transfer unit 14 to a sheet P for image recording (corresponding to an example of an image medium) is provided on the left side of the intermediate transfer unit 14.

A contact portion of the intermediate transfer belt 22 and the second transfer roller 36 defines a second transfer portion (described later). At this second transfer portion, a toner image, which is formed by the image forming unit 12, is transferred to a surface of a sheet P via the intermediate transfer belt 22.

The image forming apparatus 10 includes plural image forming units 12 that form toner layers of respective colors. In this exemplary embodiment, four image forming units 12 including an yellow image forming unit 12Y, a magenta image forming unit 12M, a cyan image forming unit 12C, and a black image forming unit 12K are provided.

In this exemplary embodiment, yellow (=Y), magenta (=M), cyan (=C), and black (=K) are basic colors to output a color image. In the following description, when the respective colors of the image forming units 12Y, 12M, 12C, and 12K do not have to be distinguished from one another, the image forming units 12Y, 12M, 12C, and 12K are merely referred to as "image forming units 12" and the image forming units 12 are described while the individual signs Y, M, C, and K indicating the image forming units of the respective colors are omitted.

The image forming units 12 of the respective colors are configured similarly to one another except for the toner to be used. As illustrated in FIG. 1, each image forming unit 12 includes a rotatable cylindrical photoreceptor 24, and a charging portion 26 that electrically charges the photoreceptor 24. In addition, the image forming unit 12 includes an exposure device 28 that forms an electrostatic latent image by irradiating the charged photoreceptor 24 with light for exposure, and a developing device 30 that develops the electrostatic latent image by using a developer including a toner, as an image formed by using a toner layer. Further, each image forming unit 12 includes a cleaning blade 29 that cleans a remaining toner remaining on the photoreceptor 24 after the toner layer is transferred to the intermediate transfer belt 22.

Each photoreceptor 24 is able to contact the intermediate transfer belt 22. In addition, as illustrated in FIG. 1, the respective image forming units 12 corresponding to yellow, magenta, cyan, and black are disposed side by side from the upstream side in a circulation direction of the intermediate transfer belt 22 (=a direction indicated by arrow X in FIG. 1, hereinafter, referred to as arrow X direction).

Intermediate Transfer Unit 14

The intermediate transfer unit 14 includes a first transfer roller 34 disposed to face the image forming unit 12 of the corresponding color, and a backup roller 33 disposed to face the second transfer roller 36.

Intermediate Transfer Belt 22

As illustrated in FIG. 1, the intermediate transfer belt 22 has an endless form. In addition, the intermediate transfer belt 22 is wound around plural rollers 32 and hence the posture thereof is determined. In this exemplary embodiment, the posture of the intermediate transfer belt 22 is determined to have an elliptic shape long in the apparatus width direction in front view. The roller on the right end side among the plural rollers 32 has a function of rotating the intermediate transfer belt 22 in the arrow X direction with power of a motor (not illustrated). The intermediate transfer belt 22 transports an image obtained by first transfer to a second transfer portion 18 (described later) by being rotated in the arrow X direction.

The intermediate transfer belt 22 is able to circulate in the arrow X direction in a state in which the intermediate transfer belt 22 is in contact with or separated from the photoreceptor 24 of each color.

First Transfer Portion

As illustrated in FIG. 1, a first transfer portion 19, which is provided for each color, is defined by a contact portion of the photoreceptor 24 and the intermediate transfer belt 22. The intermediate transfer belt 22 is pressed to the photoreceptor 24 with a predetermined load by the first transfer roller 34 disposed to face the photoreceptor 24 at each first transfer portion.

In addition, a feeding portion (not illustrated) applies a voltage to the first transfer roller 34. The voltage is a first transfer voltage to first transfer a toner image formed on the photoreceptor 24 to the intermediate transfer belt 22 at a position between the photoreceptor 24 and the first transfer roller 34.

Second Transfer Portion

As illustrated in FIG. 1, a second transfer portion 18 (=corresponding to an example of a second transfer region) is defined by a contact portion of the intermediate transfer belt 22 and the second transfer roller 36 formed in a roller shape. The intermediate transfer belt 22 contacts the second transfer roller 36 with a predetermined load by the backup roller 33 disposed to face the second transfer roller 36.

A feeding portion (not illustrated) applies a voltage to the second transfer roller 36. The voltage is a second transfer voltage used when toner images transferred to the intermediate transfer belt 22 in a superposed manner are second transferred to a sheet P transported to the second transfer portion 18.

Fixing Device

A fixing device 40 is disposed downstream of the second transfer portion 18 in a transport direction of a sheet P. The fixing device 40 includes a pair of rollers facing each other. The pair of rollers face each other with a transport path A interposed therebetween. That is, a sheet P serving as a fixing object is transported to pass through a position between the pair of rollers.

Sheet Transport Path

The sheet transport path A illustrated in FIG. 1 (hereinafter, merely referred to as "transport path") has a function of transporting a sheet P prepared in advance in a sheet tray 38. To be specific, the transport path A includes plural sheet transport rollers (not illustrated). Thus, the sheet P is transported along the transport path A to pass through the second transfer portion 18 and the fixing device 40 in that order.

Image Forming Operation of Basic Image

A basic image forming operation on a sheet P by the image forming apparatus 10 is now briefly described.

The image forming apparatus 10 includes a controller (not illustrated). When receiving an image formation command from the outside, the controller activates each image forming unit 12. The photoreceptor 24 of each color is electrically charged by the charging portion 26 while rotating. In addition, the controller transmits image data on which image processing has been provided by an image signal processor (not illustrated) to each exposure device 28. Each exposure device 28 irradiates the corresponding photoreceptor 24 with exposure light in accordance with the image data and hence exposes the charged photoreceptor 24 to the light. Thus, an electrostatic latent image is formed on the outer peripheral surface of each photoreceptor 24. The electrostatic latent image formed on each photoreceptor 24 is developed by the corresponding developing device 30, and a toner image of the corresponding color is formed on the photoreceptor 24 of the corresponding color.

The toner image of each color formed on the photoreceptor 24 of the corresponding color is first transferred to the intermediate transfer belt 22 by the first transfer roller 34 of the corresponding color at the corresponding first transfer portion. At this time, the toner images of the respective colors are sequentially first transferred to the intermediate transfer belt 22 in a manner superposed on one another while the intermediate transfer belt 22 circulates. The superposed toner image is transported to the second transfer portion by circulation of the intermediate transfer belt 22. The superposed toner image is transferred from the intermediate transfer belt 22 to a sheet P at the second transfer portion.

The sheet P to which the toner image has been second transferred is transported to the fixing device 40. In the fixing device 40, a toner image formation surface (hereinafter, occasionally referred to as "surface") of the sheet P is heated and pressed by a fixing belt, and a back surface opposite to the toner image formation surface (hereinafter, occasionally referred to as "back surface") of the sheet P is heated and pressed by a fixing roller. Thus, the toner image formed by the respective image forming units 12 is fixed to the sheet P.

When images are formed on both surfaces of a sheet P, the sheet P which has passed through the fixing device 40 is front-back inverted in the following transport path. Then, the sheet P is transported through a transport path B including plural rollers (not illustrated), and is transported to the transport path A again.

Configuration of Feature Portions

Configurations of feature portions of this exemplary embodiment are described below.

Covering 46

As illustrated in FIG. 2, the image forming apparatus 10 includes a covering 46 that covers a left side surface of the body of the apparatus. In addition, a lever 42 is provided at an upper position of a center portion of the covering 46. The lever 42 will be described later in more detail.

Interior Section 44

Figure 3:
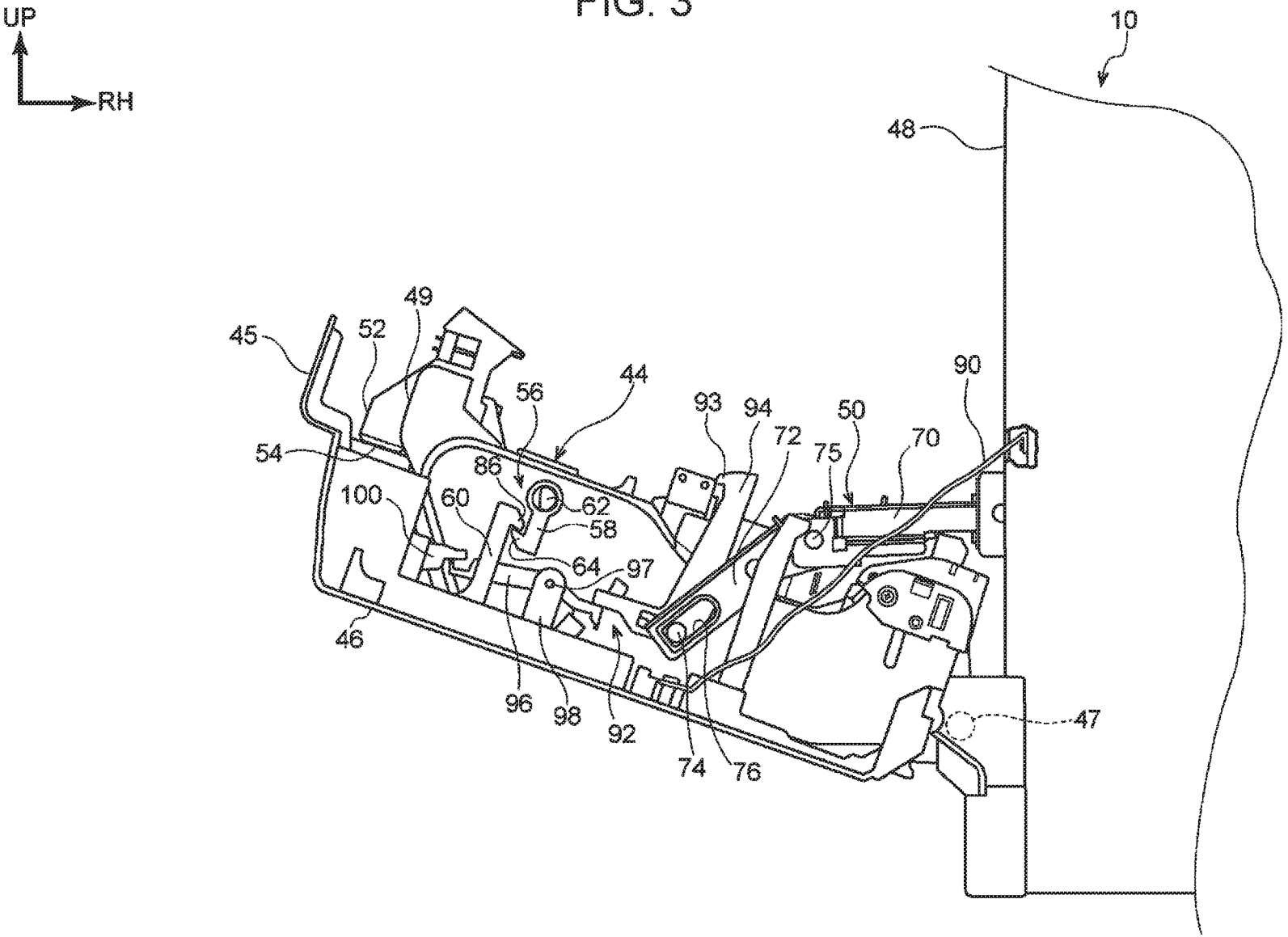
FIG. 3 is a side view illustrating a state in which an interior section and a covering of the image forming apparatus according to the exemplary embodiment are opened to the maximum angle of the interior section.

As illustrated in FIG. 3, the image forming apparatus 10 includes an interior section 44 and the covering 46. The interior section 44 is openable and closable with respect to the body of the image forming apparatus 10 around a rotation shaft 47 provided on the lower side of the interior section 44. Both end portions of a damper 50 (corresponding to an example of a first limit portion) are attached to a frame 48 of the image forming apparatus 10 and the interior section 44 at a substantially middle position in the up-down direction of the interior section 44 in a closed state. The damper 50 will be described later in more detail.

Handle 52

A handle 52 is provided on the distal end side (that is, the side opposite to the rotation shaft 47) of the interior section 44. The handle 52 has a contact surface 54 provided on the side of the covering 46. The contact surface 54 protrudes from the distal end side of the interior section 44 and is touched by a user. The contact surface 54 is close to the covering 46 in the state illustrated in FIG. 3. Thus, in the state illustrated in FIG. 3, the user has difficulty in operating the contact surface 54.

Damper 50

Figure 7:
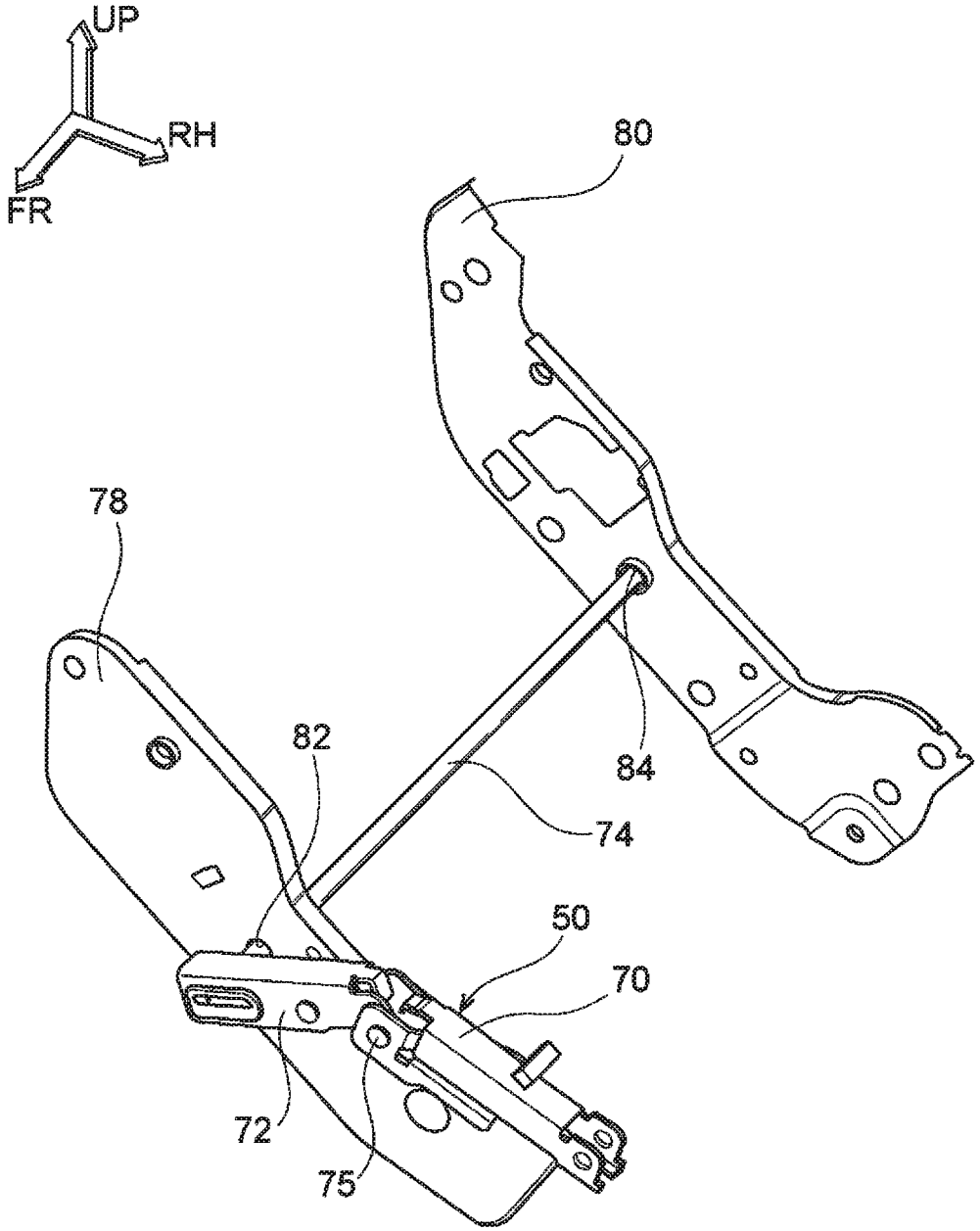
FIG. 7 is a perspective view illustrating a first limit portion, and a frame of the interior section of the image forming apparatus according to the exemplary embodiment.

As illustrated in FIGS. 3 and 7, the damper 50 is provided on only one side of the interior section 44 and the frame 48. More specifically, the damper 50 is provided on the near side of the interior section 44 and the frame 48. The damper 50 includes an arm portion 70 provided on the side near the body, an arm portion 72 provided on the side near the interior section 44, a shaft 74, and a shaft 75 that rotatably couples the arm portion 70 and the arm portion 72 to each other. The arm portion 72 has a long hole 76 that is formed along the longitudinal direction of the arm portion 72 and through which the shaft 74 is inserted.

The arm portion 70 and the arm portion 72 are rotated together around the shaft 75 and hence the damper 50 is able to be folded and deployed. Thus, the damper 50 is folded when the interior section 44 is closed, and is deployed when the interior section 44 is opened. During the folding or deploying operation of the damper 50 (hereinafter, occasionally referred to as "opening/closing operation"), a spring mechanism (not illustrated) embedded in the damper 50 gives a function of assisting the opening/closing operation (=damper function). In this case, "assist" represents that a resistance is given to avoid rapid opening of the interior section 44 when the interior section 44 is opened, and a force is added to the interior section 44 in the closing direction when the interior section 44 is closed. Thus, the opening/closing operation is easily performed although the interior section 44 is heavy.

The shaft 74 has a structure to move along the longitudinal direction of the long hole 76 along with the opening/closing operation of the interior section 44. In addition, a stopper (not illustrated) is provided between the arm portion 70 and the arm portion 72 of the damper 50. The stopper limits the maximum deployment angle of the arm portion 70 and the arm portion 72. Hence, a state in which the arm portion 70 and the arm portion 72 have the maximum deployment angle and the shaft 74 is located at an end portion of the long hole 76 on the side near the interior section 44 represents the maximum opening angle of the interior section 44 (corresponding to an example of a second state).

As illustrated in FIG. 7, the shaft 74 is inserted through a hole 82 and a hole 84 provided at corresponding positions of a near-side plate 78 and a far-side plate 80 of the interior section 44. The near-side plate 78 and the far-side plate 80 are provided along exterior surfaces on the near side and the far side of the image forming apparatus 10. In addition, respective components mounted on the interior section 44 are directly or indirectly fixed to the near-side plate 78 and the far-side plate 80. With this structure, during the opening/closing operation of the interior section 44, the damper function is added by using the damper 50.

Coupling Portion 56

As illustrated in FIG. 3, the interior section 44 and the covering 46 are releasably coupled to each other by a coupling portion 56 provided on the near side of the image forming apparatus 10. The coupling portion 56 includes an upper coupling portion 58 and a lower coupling portion 60.

The upper coupling portion 58 includes a shaft 62 nearer to the rotation shaft 47 than the handle 52 of the interior section 44, and a hook 64 extending from the shaft 62 toward the covering 46 and protruding toward the distal end side.

The lower coupling portion 60 is fixed to the covering 46 at a position corresponding to the upper coupling portion 58. The lower coupling portion 60 has a columnar shape vertically extending from the covering 46 toward the interior section 44. In addition, the lower coupling portion 60 has a hook 86 located at a distal end thereof on the side near the interior section 44 and protruding toward the rotation shaft 47. The hook 86 meshes with the hook 64, and hence the upper coupling portion 58 and the lower coupling portion 60 are coupled to each other, thereby restricting separation of the upper coupling portion 58 and the lower coupling portion 60. The upper coupling portion 58 is attached to the interior section 44, and the lower coupling portion 60 is fixed to the covering 46. Hence, by coupling the upper coupling portion 58 and the lower coupling portion 60 to each other, the interior section 44 and the covering 46 are coupled to each other.

Figure 8:
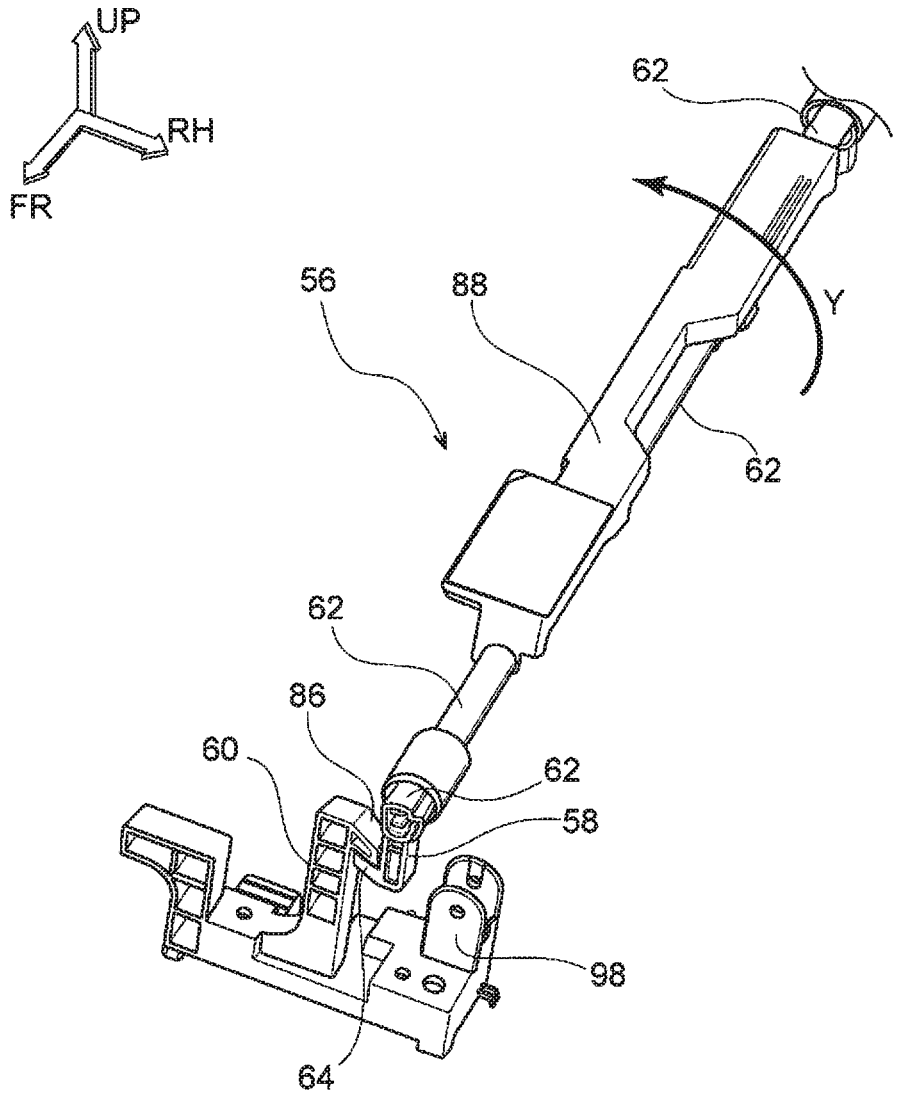
FIG. 8 is a perspective view illustrating a coupling portion of the image forming apparatus according to the exemplary embodiment.

As illustrated in FIG. 8, the shaft 62 is provided to extend from the near side to the far side of the apparatus. In addition, a handle 88 is provided at a center portion in the depth direction of the shaft 62. The user operates the handle 88. When the user rotates the handle 88 in a direction indicated by arrow Y (hereinafter, referred to as arrow Y direction), the hook 64 rotates in the arrow Y direction, and the coupling of the hook 64 and the hook 86 is released.

Strap 90

Figure 6:
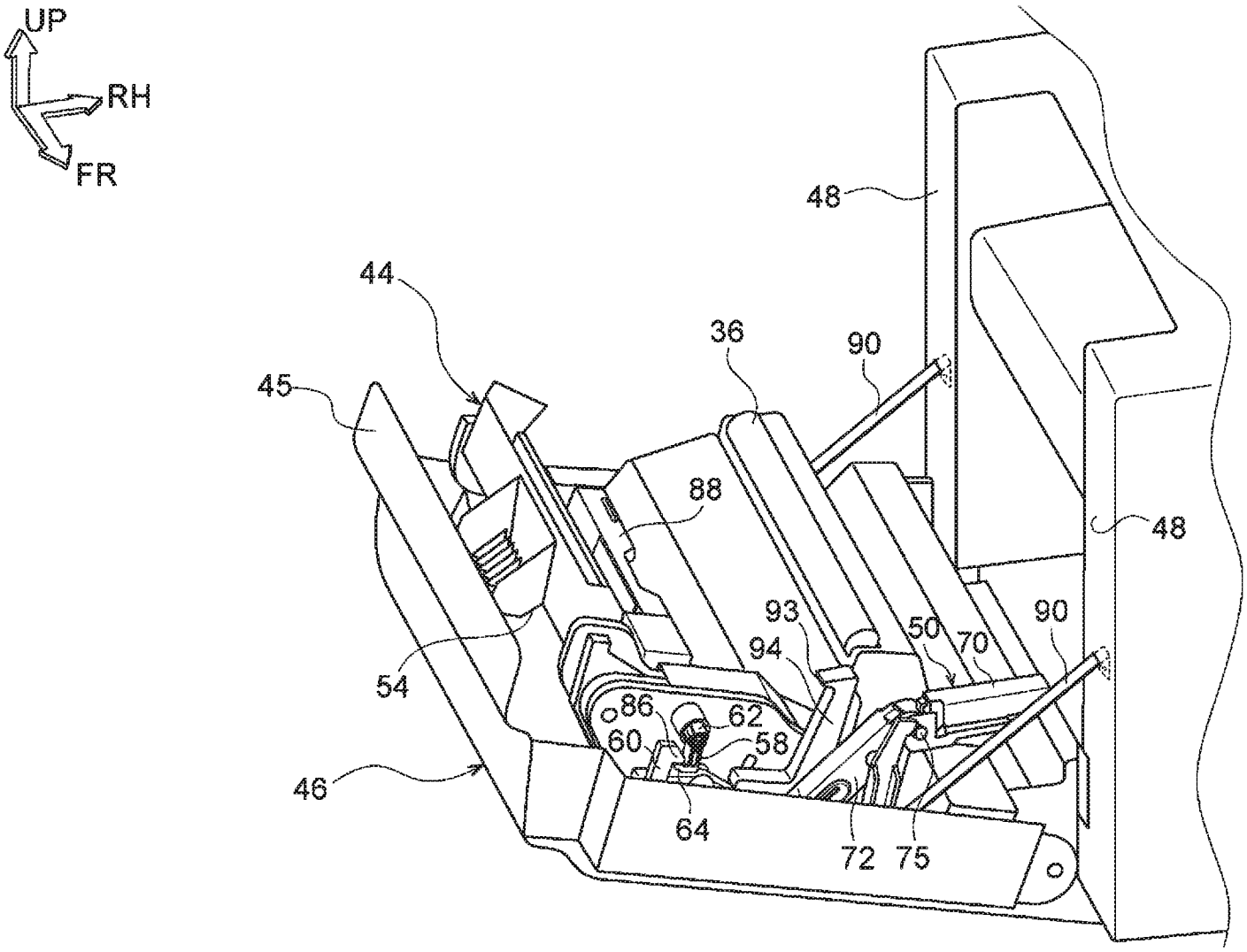
FIG. 6 is a perspective view illustrating the state in which the interior section and the covering of the image forming apparatus according to the exemplary embodiment are opened to the maximum angle of the interior section.

Straps 90 (corresponding to an example of a second limit portion) are provided on the near side and the far side of the covering 46. One end of each of the straps 90 is coupled to the frame 48 of the body of the image forming apparatus 10, and the other end thereof is coupled to the covering 46. The coupling positions of the straps 90 with respect to the covering 46 are between the rotation shaft 47 and a cover distal end 45 and is near the rotation shaft 47 of the cover 46. As illustrated in FIG. 6, the straps 90 each have a flat surface shape having a width in the depth direction.

Lock Mechanism 92

As illustrated in FIG. 3, a lock mechanism 92 is provided at side surfaces on the near side of the interior section 44 and the covering 46. The lock mechanism 92 includes a hook 94, a relay portion 96, a relay support portion 98, and a trigger 100.

The hook 94 is rotatably provided on the near side of the shaft 74 of the interior section 44, while the shaft 74 serves as a rotation shaft. The hook 94 is attached in a state urged counterclockwise in FIG. 3. The hook 94 is formed in an inverted L shape having its longitudinal direction along a direction away from the covering 46 while the shaft 74 serves as the start point (that is, toward the body of the image forming apparatus 10 when the interior section 44 is closed). A protruding portion 93 is formed at a distal end portion in the longitudinal direction of the hook 94. The protruding portion 93 protrudes toward the distal end 49 of the interior section 44.

The relay portion 96 is formed to have its longitudinal direction along a direction in which the rotation shaft 47 and the distal end 49 of the interior section 44 are connected to each other. A middle portion of the relay portion 96 in the longitudinal direction is supported by the relay support portion 98 rotatably relative to the relay support portion 98 via a rotation shaft 97. In addition, an end portion of the relay portion 96 on the side near the rotation shaft 47 comes into contact with a distal end portion in the transverse direction of the hook 94. Specifically, the relay portion 96 is urged clockwise by the hook 94. The relay support portion 98 is fixed to the covering 46 so as to protrude from the covering 46 toward the interior section 44.

The trigger 100 is attached to the covering 46 by a mechanism (not illustrated) in a manner associated with the lever 42. An end portion of the trigger 100 near the rotation shaft 47 is in contact with an end portion of the relay support portion 98 on the side opposite to the hook 94 in a state in which the relay support portion 98 is urged so as not to rotate.

When the user actuates the lever 42, the trigger 100 is moved in an associated manner, and rotates the relay portion 96, which is in contact with the trigger 100, counterclockwise in FIG. 3. Thus, the hook 94 is rotated clockwise.

Operations and Advantages

Operations and advantages of this exemplary embodiment are described below.

Opening/Closing Operation of Covering 46 and Interior Section 44

As illustrated in FIG. 2, in the state in which the interior section 44 and the covering 46 are closed, the interior section 44 is locked to the image forming apparatus 10 by the lock mechanism 92. Specifically, the protruding portion 93 of the hook 94 is hooked to a hole (not illustrated) provided at a corresponding position of the frame 48, and hence the interior section 44 is closed with respect to the body of the image forming apparatus 10. At this time, the covering 46 coupled to the interior section 44 by the coupling portion 56 is also closed with respect to the body of the image forming apparatus 10 similarly to the interior section 44. The state in which the interior section 44 and the covering 46 are closed with respect to the body of the image forming apparatus 10 as described above corresponds to an example of a first state.

When the lock mechanism 92 is unlocked by the operation of the user with the lever 42, the covering 46 and the interior section 44 are opened from the body of the image forming apparatus 10 by the weight of the covering 46 and the interior section 44. At this time, the damper 50 reduces the speed of the opening operation. Since the speed is reduced, when the interior section 44 reaches the maximum opening angle, deformation of each of the damper 50, the attachment portion of the damper 50 and the interior section 44, the attachment portion of the interior section 44 and the coupling portion 56, the coupling portion 56, and the attachment portion of the coupling portion 56 and the covering 46 due to a load received by each of that portions may be reduced as compared with a configuration that employs a limit portion without the damper function.

As illustrated in FIG. 3, when the opening of the interior section 44 reaches an angle corresponding to the maximum opening angle of the damper 50, the interior section 44 and the covering 46 are in the state coupled to each other by the coupling portion 56. The state in which the angle between the interior section 44 and the covering 46 is limited to the angle corresponding to the maximum opening angle of the damper 50 by the damper 50 as described above corresponds to a second state.

At this time, the straps 90 are loosened. Thus, the covering 46 is not limited by the straps 90 in the second state.

In addition, at this time, the user has difficulty in touching the contact surface 54 of the handle 52. Thus, when the interior section 44 is closed with respect to the image forming apparatus 10, the covering 46 coupled to the interior section 44 follows the interior section 44, and the user's hand is not pinched between the body of the image forming apparatus 10 and the covering 46.

Figure 4:
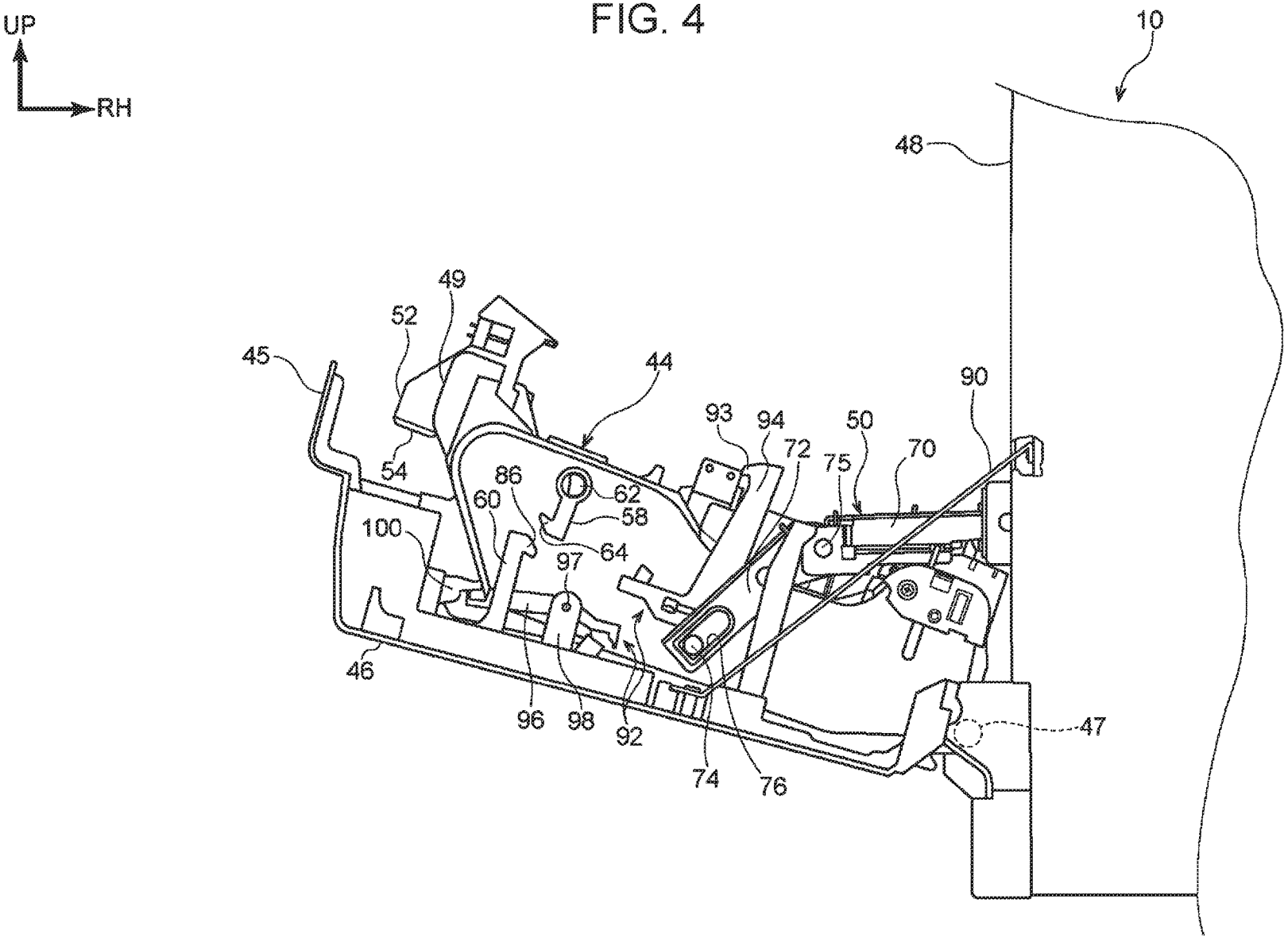
FIG. 4 is a side view illustrating the state in which the interior section and the covering of the image forming apparatus according to the exemplary embodiment are opened to the maximum angle.

In the second state, when the user rotates the handle 88, the coupled state of the coupling portion 56 is released. Then, as illustrated in FIG. 4, the covering 46 is separated from the interior section 44, and is opened to an angle larger than the maximum opening angle of the damper 50. Then, the straps 90 limit the maximum opening angle of the covering 46. The state in which the interior section 44 and the covering 46 are opened to the respective maximum opening angles as described above corresponds to an example of a third state.

The angle by which the interior section 44 opens while the state shifts from the second state to the third state is smaller than the angles by which the covering 46 and the interior section 44 are opened while the state shifts from the first state to the second state. The angle between the interior section 44 provided at the covering 46 and the body of the image forming apparatus 10 is an angle defined by an imaginary line extending from the interior section 44 and intersecting with the body of the image forming apparatus 10. In addition, the covering 46 is made of more lightweight material and structure as compared with those of the interior section 44. Thus, the straps 90 that limit the opening of the covering 46 when the state shifts from the second state to the third state each may employ a member of a simple and less strength structure as compared with the damper 50 that limits the opening of the covering 46 and the interior section 44 when the state shifts from the first state to the second state.

The covering 46 is coupled to the interior section 44 by the coupling portion 56 while the state shifts from the first state to the second state. In this case, the coupling portion 56 is provided nearer to the distal end 49 of the interior section 44 than the straps 90. That is, the straps 90 are provided between the frame 48 and a portion of the covering 46 nearer to the rotation shaft 47 than the coupling portion 56. Since the coupling portion 56 is provided at the position separated from the rotation shaft 47 of the covering 46, the coupling portion 56 may be coupled to the covering 46 and the interior section 44 by a simple and less strength structure as compared with, for example, a configuration in which the coupling portion 56 is provided at a position similar to the attachment positions of the straps 90 and the covering 46.

In the third state, the contact surface 54 of the handle 52 is separated from the covering 46. Thus, the user may touch the contact surface 54. At this time, the coupling between the interior section 44 and the covering 46 is released.

Figure 5:
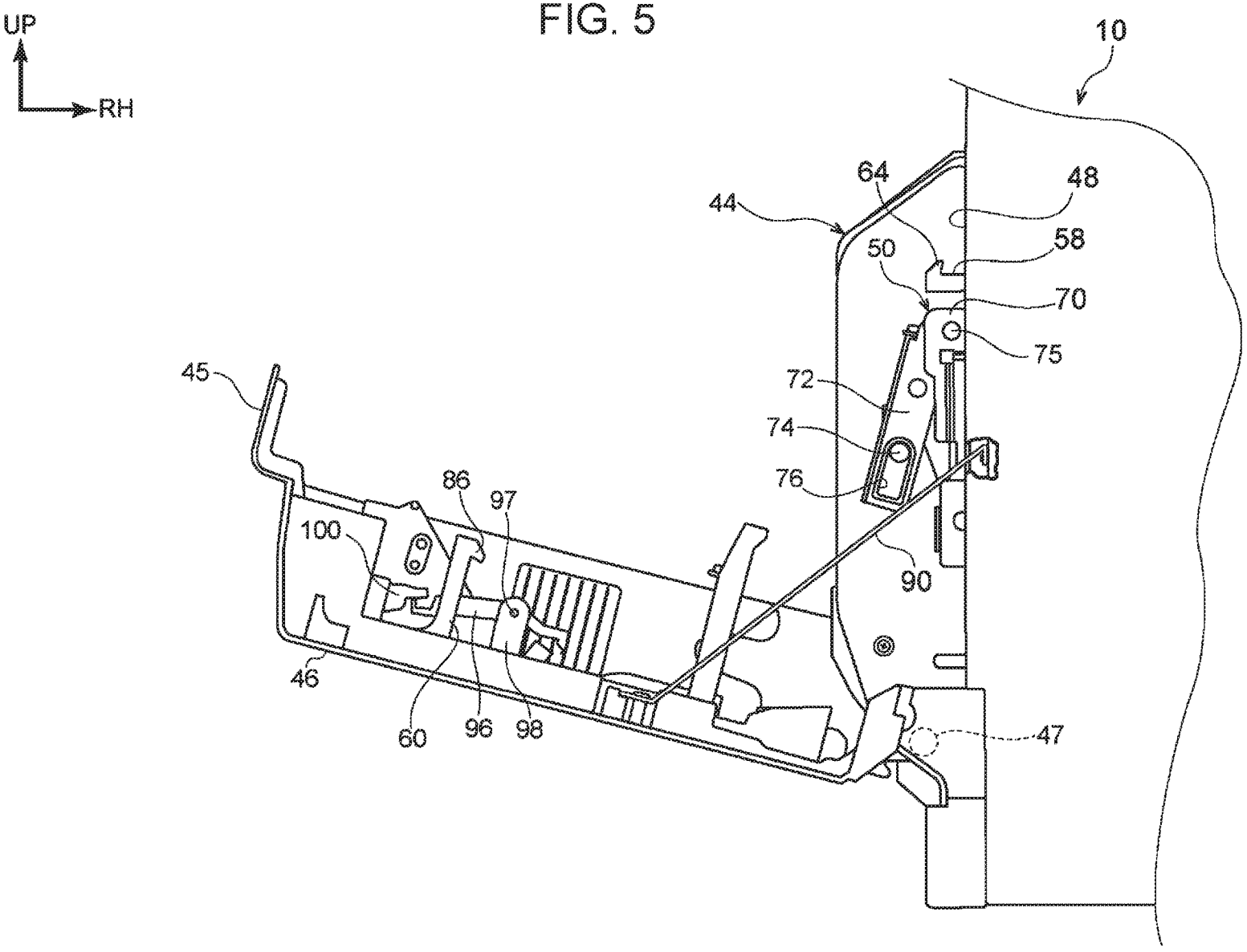
FIG. 5 is a side view illustrating a state in which only the covering of the image forming apparatus according to the exemplary embodiment is opened.

As illustrated in FIG. 5, the interior section 44 is closable to the body of the image forming apparatus 10 independently from the covering 46 by passing through the third state. As described above, when the user presses the contact surface 54 and closes the interior section 44 to the body of the image forming apparatus 10, the covering 46 does not follow the interior section 44. Thus, the user's hand is not pinched between the body of the image forming apparatus 10 and the covering 46.

Modifications

While the image forming apparatus according to this exemplary embodiment has been described above, various modifications may be made within the scope not departing from the gist of the disclosure.

For example, the damper 50 may be a configuration including a coil spring, a helical spring, or a brake spring, or may be a structure that gives a limit by using a reel and a retractor. The straps 90 may be replaced with dampers, or rubber members or air cylinders having an extending and contracting function. Further, the damper 50 and the straps 90 may be a structure integrated with the rotation shaft 47.

In this exemplary embodiment, while the interior section 44 and the covering 46 have the same rotation shaft 47, the interior section 44 and the covering 46 may have rotation shafts at positions differ from each other. Further, in this exemplary embodiment, while the coupling of the coupling portion 56 is released by the operation with the handle 88, for example, the coupling state may be automatically released when the interior section 44 and the covering 46 shift from the first state to the second state.

In addition, in this exemplary embodiment, while the damper 50 is provided on only the near side of the interior section 44, the damper 50 may be provided on both the near side and the far side. In this case, a load is exerted from the dampers provided on the near side and the far side to the interior section 44 in a distributed manner, the likelihood of occurrence of deformation in the interior section 44 is decreased. Thus, the structure of the shaft 74 is not limited to that the shaft 74 is provided to extend from the near-side plate 78 to the far-side plate 80.

In this exemplary embodiment, while the coupling portion 56 includes the upper coupling portion 58 and the lower coupling portion 60 on only the near side of the interior section 44, the coupling portion 56 may include the upper coupling portion 58 and the lower coupling portion 60 on each of both the near side and the far side, or only on the far side. In addition, the coupling portion 56 may be assembled with a center portion of the interior section 44 in the depth direction. By changing the arrangement of the coupling portion 56 as described above, deformation of the covering 46, which is expected depending on the design and specifications, may be suppressed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a covering provided along a side surface of a body of the image forming apparatus, provided with a rotation shaft on a lower side of the covering, and provided to be openable and closable with respect to the body;

an interior section provided on a side of the covering near the body, releasably coupled to the covering by a coupling portion, and provided to be openable and closable with respect to the body;

a first limit portion that is attached to the interior section and the body, and that limits a maximum opening angle between the interior section and the body; and a second limit portion that is attached to the covering and the body, and that limits a maximum opening angle between the covering and the body to an angle larger than the maximum opening angle between the interior section and the body, wherein the first limit portion has a higher strength than a strength of the second limit portion.

2. The image forming apparatus according to claim 1, wherein the first limit portion has a damper function.

3. The image forming apparatus according to claim 2, wherein the interior section includes a handle that is exposed when an opening angle of the covering is larger than an opening angle of the interior section.

4. The image forming apparatus according to claim 1, wherein the interior section includes a handle that is exposed when an opening angle of the covering is larger than an opening angle of the interior section.

5. An image forming apparatus comprising:

a covering provided along a side surface of a body of the image forming apparatus, provided with a rotation shaft on a lower side of the covering, and provided to be openable and closable with respect to the body;

an interior section provided on a side of the covering near the body and provided to be openable and closable with respect to the body together with the covering;

a coupling portion that is attached to the body and the interior section and the covering, that provides coupling while the interior section is opened from a first state, in which the interior section is closed, to a second state, and that releasably couples the interior section and the covering; and a second limit portion that is attached to a portion of the covering nearer to the rotation shaft than the coupling portion, and that limits an opening angle of the covering in a third state in which the covering is opened to a maximum opening angle of the covering set to be larger than an opening angle of the interior section, wherein the interior section includes a handle that is exposed when the opening angle of the covering is larger than the opening angle of the interior section.

6. An image forming apparatus comprising:

a covering provided along a side surface of a body of the image forming apparatus, provided with a rotation shaft on a lower side of the covering, and provided to be openable and closable with respect to the body;

an interior section provided on a side of the covering near the body, releasably coupled to the covering by a coupling portion, and provided to be openable and closable with respect to the body;

a first limit portion that is attached to the interior section and the body, and that limits a maximum opening angle between the interior section and the body; and a second limit portion that is attached to the covering and the body, and that limits a maximum opening angle between the covering and the body to an angle larger than the maximum opening angle between the interior section and the body, wherein the interior section includes a handle that is exposed when an opening angle of the covering is larger than an opening angle of the interior section.

* * * * *